US010028353B2

(12) United States Patent
Chen

(10) Patent No.: US 10,028,353 B2
(45) Date of Patent: Jul. 17, 2018

(54) LED LAMP STRING HAVING SELECTABLE LIGHT EMITTING MODE

(71) Applicant: TAIZHOU HEYSTAR ELECTRONIC TECHNOLOGY CO., LTD, Linhai, Zhejiang Province (CN)

(72) Inventor: Yingping Chen, Linhai (CN)

(73) Assignee: TAIZHOU HEYSTAR ELECTRONIC TECHNOLOGY CO., LTD (CN)

( * ) Notice: Subject to any disclaimer, the term of this patent is extended or adjusted under 35 U.S.C. 154(b) by 0 days.

(21) Appl. No.: 15/512,842

(22) PCT Filed: Jan. 29, 2016

(86) PCT No.: PCT/CN2016/072725

§ 371 (c)(1),
(2) Date: Mar. 21, 2017

(87) PCT Pub. No.: WO2017/036087

PCT Pub. Date: Mar. 9, 2017

(65) Prior Publication Data

US 2017/0311407 A1 Oct. 26, 2017

(30) Foreign Application Priority Data

Aug. 29, 2015 (CN) ..... 2015 1 0539201
Aug. 29, 2015 (CN) ..... 2015 2 0660211 U

(51) Int. Cl.
*H05B 33/08* (2006.01)
*H05B 37/02* (2006.01)
(Continued)

(52) U.S. Cl.
CPC ..... *H05B 33/0863* (2013.01); *F21S 4/10* (2016.01); *F21V 23/06* (2013.01);
(Continued)

(58) Field of Classification Search
CPC ..... H05B 33/0863; H05B 33/0815; H05B 33/0845; H05B 37/0272
(Continued)

(56) References Cited

U.S. PATENT DOCUMENTS

2007/0026421 A1* 2/2007 Sundberg ..... B01L 3/5027 435/6.12
2008/0284929 A1* 11/2008 Kimura ..... G02F 1/13624 349/38

(Continued)

*Primary Examiner* — Thai Pham
*Assistant Examiner* — Syed M Kaiser
(74) *Attorney, Agent, or Firm* — PROI Intellectual Property US

(57) ABSTRACT

The present invention relates to the technical field of LED decorative lighting, and particularly relates to an LED lamp string having a selectable light emitting mode. The LED lamp string comprises a power line positive electrode, a power line negative electrode, a controller, an input positive electrode of the lamp string, an input negative electrode of the lamp string, a lamp string group and a conductive connection wire. In the present invention, one or more types of LEDs having a selectable light emitting mode from multiple light emitting modes are selected according to a customer demand, and synchronous control of one single type of LEDs on the multiple light emitting modes thereof is realized, thus creating a variable and diversified light emitting effect, and meeting the light emitting customization requirement for users.

17 Claims, 6 Drawing Sheets

(51) Int. Cl.
*F21S 4/10* (2016.01)
*F21V 23/06* (2006.01)
*F21Y 115/10* (2016.01)

(52) U.S. Cl.
CPC ..... *H05B 33/0815* (2013.01); *H05B 33/0845* (2013.01); *H05B 37/0272* (2013.01); *F21Y 2115/10* (2016.08)

(58) Field of Classification Search
USPC ..... 315/192, 294, 291, 224, 307
See application file for complete search history.

(56) References Cited

U.S. PATENT DOCUMENTS

2009/0143761 A1* 6/2009 Cantor ..... A61N 1/044 604/501
2009/0322990 A1* 12/2009 Kawana ..... G02B 6/0073 349/68
2011/0117637 A1* 5/2011 Gray ..... G01N 21/6452 435/287.2
2012/0244532 A1* 9/2012 Craighead ..... B01L 3/502761 435/6.11
2013/0260246 A1* 10/2013 Chen ..... H01M 4/133 429/221
2013/0278158 A1* 10/2013 Kim ..... H05B 33/0896 315/192
2014/0027751 A1* 1/2014 Furukawa ..... C09K 11/06 257/40
2016/0172340 A1* 6/2016 Lu ..... H01L 25/0753 257/89

* cited by examiner

LED LAMP STRING HAVING SELECTABLE LIGHT EMITTING MODE

CROSS REFERENCE TO RELATED APPLICATIONS

The present application is the US national stage of International Patent Application PCT/CN2016/072725 filed on Jan. 29, 2016, which, in turn, claims priority to Chinese Patent Applications CN 201510539201.3 filed on Aug. 29, 2015 and CN 201520660211.8 filed on Aug. 29, 2015.

BACKGROUND

Technical Field

The present invention belongs to the technical field of LED decorative lighting, and in particular to an LED lamp string having a selectable light emitting mode in which the lighting modes of lamp beads are controllable and do affect each other.

Related Art

Decorative lamps are indispensable electronic decorative products for home, festival celebration, public place night scene decoration and so on, and they have a huge market scale.

LED lamp strings available on current markets have the light emitting parts composed of common LED lamp beads. A first type is that the lamp string can light for a long time only, with a single lighting mode; a second type is that the lamp string has a controller and multiple outputs, the light emitting parts of this lamp string also are composed of common LED lamp beads, each output controls the change of one or more groups, the change of each output is uniform and inflexible; a third type is that the lamp string adopts an RGB lamp bead inbuilt with a control chip, the lamp bead has two extended pins too, however, this lamp string can achieve automatically cycled alternating lighting modes only, each lighting mode can stay for a short time only, a user cannot select certain preset lighting mode on his/her own, moreover, the automatic changing lighting mode would make people feel dizzy; a fourth type is that the lamp string adopts a electrodeless double-color lamp bead which has two extended pins too, the change of lighting mode is realized by the switch of current direction at the input end, however, this change is realized by a controller arranged in the lamp string, only two colors are allowed for the change, the lamp string cannot realize the color change caused by the LED chip inbuilt in the lamp bead controlling the synthesis of light; a fifth type is that the RGB bead is inbuilt with a control chip too, the lamp string has varied and rich lighting modes, however, the lamp bead has three to four extended pins, in which one to two pins are signal pins with a signal line, this lamp string is complex and difficult to manufacture and is high in cost.

In short, all decorative lamp strings available on current markets cannot meet the product requirement of people that one same lamp string has a plurality of lighting modes such as wide color changes, on and off, bright and dark, and flickering, and that one of the lighting modes may be selected.

SUMMARY

In view of the above problem in existing technologies, the present invention aims to provide an LED lamp string having a selectable light emitting mode, which is very simple in lamp string structure and very low in lamp string manufacturing cost, is beneficial for mass production and diverse in lighting modes, and can realize the synchronous control of one same type of lamp beads, and in which various lighting modes of one same type of light-emitting-selectable LED lamp beads are synchronously controllable by installing on the lamp string a plurality of or all light-emitting-selectable LED lamp beads of the same or different types and by operating a controller.

The LED lamp string having a selectable light emitting mode comprises a power line positive electrode, a power line negative electrode, a controller, a lamp string input positive electrode, a lamp string input negative electrode, a lamp string set and a connecting wire, and is characterized in that: one end of the power line positive electrode and one end of the power line negative electrode are connected with a positive electrode and a negative electrode of a direct-current power respectively; the other end of the power line positive electrode and the other end of the power line negative electrode are respectively connected with the input end of the controller; the output end of the controller is connected with the lamp string input positive electrode and the lamp string input negative electrode respectively; the lamp string set comprises at least one lamp substring and at least one light-emitting-selectable LED lamp bead; the light-emitting-selectable LED lamp bead used on the lamp string set is of the same or different types; after the LED lamp string is electrified, by operating the controller, each light-emitting-selectable LED lamp bead on the lamp string lights up according to a set mode, and various lighting modes of one same type of light-emitting-selectable LED lamp beads are synchronously controllable; and all light-emitting-selectable LED lamp beads used on the LED lamp string set have the same lighting mode switching way.

The LED lamp string having a selectable light emitting mode is characterized in that, on the lamp string set, a plurality of lamp substring sets are connected with each other in parallel or in series through the connecting wire.

The LED lamp string having a selectable light emitting mode is characterized in that, on the lamp substring, a common LED bead and the light-emitting-selectable LED lamp bead, the light-emitting-selectable LED lamp bead and the light-emitting-selectable LED lamp bead are connected with each other in parallel or in series through the connecting wire.

The LED lamp string having a selectable light emitting mode is characterized in that the light-emitting-selectable LED lamp bead comprises a lamp bead encapsulation body, and a lamp bead positive electrode pin, an encapsulation wire, a control chip, a lamp bead negative electrode pin and an LED light emitting chip that are fixed on the lamp bead encapsulation body, wherein the power positive electrode of the control chip is connected with the lamp bead positive electrode pin through the encapsulation wire, the power negative electrode of the control chip is connected with the lamp bead negative electrode pin through the encapsulation wire, one electrode of the LED light emitting chip is connected with the output end of the control chip through the encapsulation wire, the other electrode of the LED light emitting chip is connected with the lamp bead negative electrode pin through the encapsulation wire or conductive glue, the lamp bead encapsulation body is used to fix and protect the lamp bead positive electrode pin, the control chip, the encapsulation wire, the LED light emitting chip and the lamp bead negative electrode pin and to achieve the function of lamp bead shaping.

The LED lamp string having a selectable light emitting mode is characterized in that the LED light emitting chip comprises at least one of an LED light emitting chip A, and/or an LED light emitting chip B, and/or an LED light emitting chip C, and/or an LED light emitting chip D, wherein one electrode of the LED light emitting chip A, one electrode of the LED light emitting chip B, one electrode of the LED light emitting chip C and one electrode of the LED light emitting chip D are connected with the output ends PB1, PB2, PB3 and PB4 of the control chip respectively, and the other electrode of the LED light emitting chip A, the other electrode of the LED light emitting chip B, the other electrode of the LED light emitting chip C and the other electrode of the LED light emitting chip D are connected with the lamp bead negative electrode pin through the encapsulation wire or conductive glue.

The LED lamp string having a selectable light emitting mode is characterized in that a plurality of lighting modes are set inside the control chip according to the configuration of the LED light emitting chip and the requirements of a user.

The LED lamp string having a selectable light emitting mode is characterized in that the LED lamp string further comprises a remote controller, which is connected with the controller through a radio signal.

The LED lamp string having a selectable light emitting mode is characterized in that the control chip, the number and type of the LED light emitting chips and the corresponding connection modes arranged in one same type of light-emitting-selectable LED lamp beads are the same.

By adopting the above technology, the present invention has benefits as follows when compared with existing technologies.

(1) In the present invention, according to the requirements of a customer, all lamp substrings of the lamp string set may adopt the light-emitting-selectable LED lamp beads of the same or different lighting modes or may be formed by connecting the common LED lamp bead and the light-emitting-selectable LED lamp bead in series or in parallel, the lamp string has diverse lighting effects and high selectivity.

(2) The common LED lamp bead and the light-emitting-selectable LED lamp bead of the present invention both have two encapsulation pins only; the two pins in the present invention are utilized to serve as both power pin and signal pin, thereby simplifying the connection structure of the lamp string, reducing the manufacturing cost of the lamp string and being beneficial for mass production.

(3) The present invention adopts different types of light-emitting-selectable LED lamp beads, each of which has a different lighting mode; the different types of light-emitting-selectable LED lamp beads are arranged on one same lamp string and do not affect each other; the light-emitting-selectable LED lamp beads may be selected according to the requirements of a customer.

(4) The controller in the present invention is equivalent to a pulse signal generator; when the circuit is just electrified, each light-emitting-selectable LED lamp bead on the lamp string lights up uniformly first according to the first mode of the plurality of lighting modes built therein; by operating the controller, each light-emitting-selectable LED lamp bead switches lighting in sequence according to the plurality of lighting modes set therein, that is, each time the "mode switch" is operated, the controller sends a pulse signal to the light-emitting-selectable LED lamp bead on the lamp string immediately, and each light-emitting-selectable LED lamp bead switches the lighting mode for one time according to the received signal, after all the inbuilt lighting modes are switched, the lighting mode will automatically return to the first lighting mode, the lighting modes are cycled in sequence in this way; the different lighting modes of adjacent light-emitting-selectable LED lamp beads do not affect each other, all light-emitting-selectable LED lamp beads of one same type realize the synchronous control of various lighting modes, the lamp string has changeable and diverse lighting effects, and meets the personalized lighting requirements of people.

Figure 1:
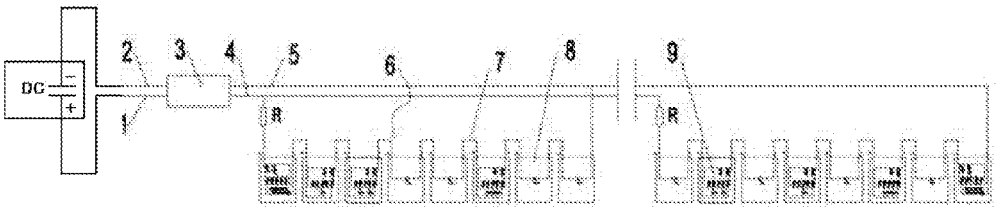
FIG. 1 is a structure diagram of a first embodiment of the present invention.

In the drawings: 1 represents a power line positive electrode, 2 represents a power line negative electrode, 3 represents a controller, 4 represents lamp string input positive electrode, 5 represents a lamp string input negative electrode, 6 represents a lamp string set, 7 represents a connecting wire, 8 represents a common LED lamp bead, 9 represents a light-emitting-selectable LED lamp bead, 901 presents a lamp bead positive electrode pin, 902 represents a lamp bead encapsulation body, 903 represents an encapsulation wire, 904 represents an LED light emitting chip, 904*a* represents an LED light emitting chip A, 904*b* represents an LED light emitting chip B, 904*c* represents an LED light emitting chip C, 904*d* represents an LED light emitting chip D, 905 represents a control chip, 906 represents a lamp bead negative electrode pin.

DESCRIPTION OF THE EMBODIMENTS

The present invention is illustrated below in further detail in conjunction with the drawings of the description.

As shown in FIG. 1, an LED lamp string having a selectable light emitting mode provided by the present invention comprises a power line positive electrode 1, a power line negative electrode 2, a controller 3, a lamp string input positive electrode 4, a lamp string input negative electrode 5, a lamp string set 6 and a connecting wire 7; one end of the power line positive electrode 1 and one end of the power line negative electrode 2 are connected with a positive electrode and a negative electrode of a direct-current power respectively; the other end of the power line positive electrode 1 and the other end of the power line negative electrode 2 are respectively connected with the input end of the controller 3; the output end of the controller 3 is connected with the lamp string input positive electrode 4 and the lamp string input negative electrode 5 respectively; the lamp string set 6 comprises at least one lamp substring and at least one light-emitting-selectable LED lamp bead 9; after the LED lamp string is electrified, each light-emitting-selectable LED lamp bead 9 on the lamp string lights up according to a set mode; the controller 3 of the present invention is equivalent to a pulse signal generator, which may be connected with a remote controller or may be controlled directly.

The light-emitting-selectable LED lamp bead 9 of the present invention comprises a lamp bead encapsulation body 902, and a lamp bead positive electrode pin 901, an encapsulation wire 903, a control chip 905, a lamp bead negative electrode pin 906 and an LED light emitting chip 904 that are fixed on the lamp bead encapsulation body 902; the power positive electrode of the control chip 905 is connected with the lamp bead positive electrode pin 901 through the encapsulation wire 903; the power negative electrode of the control chip 905 is connected with the lamp bead negative electrode pin 906 through the encapsulation wire 903; one electrode of the LED light emitting chip is connected with the output end of the control chip 905 through the encapsulation wire 903, the other electrode of the LED light emitting chip is connected with the lamp bead negative electrode pin 906 through the encapsulation wire 903 or conductive glue, the lamp bead positive electrode pin 901 and the lamp bead encapsulation body 902 are connected with the connecting wire 7, the lamp bead encapsulation body 902 is used to fix and protect the lamp bead positive electrode pin 901, the control chip 905, the encapsulation wire 903, the LED light emitting chip 904 and the lamp bead negative electrode pin 906 and to achieve the function of lamp bead shaping. In the present invention, there may be a single LED light emitting chip 904 and/or one type of LED light emitting chips 904, or may be multiple LED light emitting chip 904*s* and/or multiple types of LED light emitting chips 904; light-emitting-selectable LED lamp beads 9 containing different numbers or types of LED light emitting chips 904 and different control chips 905 have different lighting modes.

Figure 7:
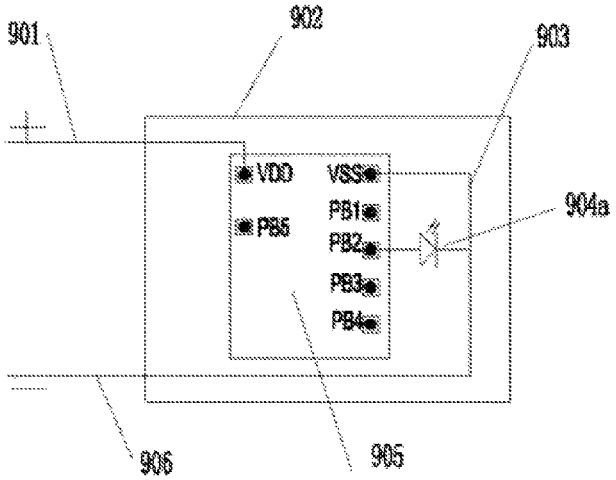
FIG. 7 is a structure diagram of a first light-emitting-selectable LED lamp bead of the present invention.

The light-emitting-selectable LED lamp bead 9 as shown in FIG. 7 has only one LED light emitting chip 904*a* in it, and the light-emitting-selectable LED lamp bead 9 may have a plurality of lighting modes, such as on and off, bright and dark, and different flickering ways; these lighting modes are preset in the control chip 905 according to the requirements of a customer; after set, the lighting modes are fixed and sequential; after the lamp string is electrified, the lamp lights up first according to a first mode; by operating the controller 3, the lamp lights up according to a plurality of set lighting modes in sequence repeatedly.

Figure 8:
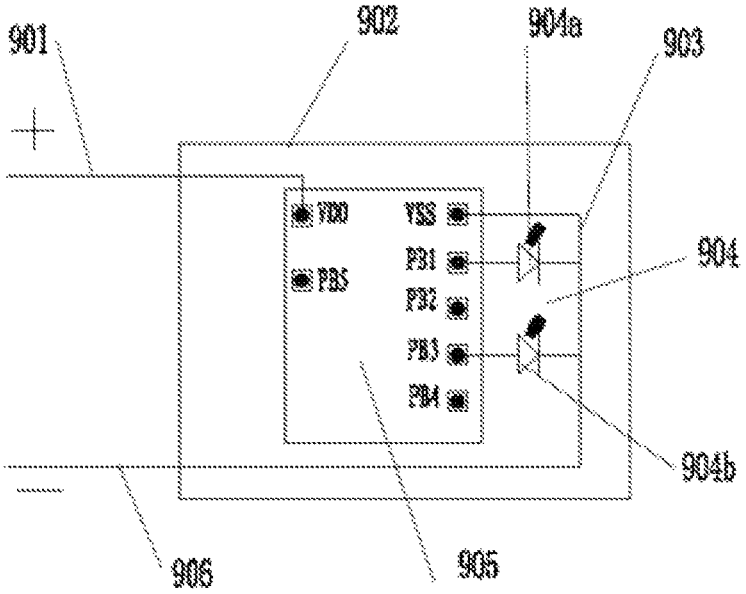
FIG. 8 is a structure diagram of a second light-emitting-selectable LED lamp bead of the present invention.

The light-emitting-selectable LED lamp bead 9 as shown in FIG. 8 has two LED light emitting chips in it, namely, LED light emitting chip A 904*a* and LED light emitting chip B 904*b*, and the light-emitting-selectable LED lamp bead 9 may have a plurality of lighting modes, such as color change (single-color lighting according to a single-color light emitting chip of LED light emitting chip A 904*a* or LED light emitting chip B 904*b*, or blending-color lighting according to the blending color formed by different proportions of the two light emitting chips), on and off, bright and dark, and a plurality of flickering ways with different illuminant colors; these lighting modes are preset in the control chip 905 according to the requirements of a customer; after set, the lighting modes are fixed and sequential; after the lamp string is electrified, the lamp lights up first according to a first mode; by operating the controller 3, the lamp lights up according to a plurality of set lighting modes in sequence repeatedly.

Figure 9:
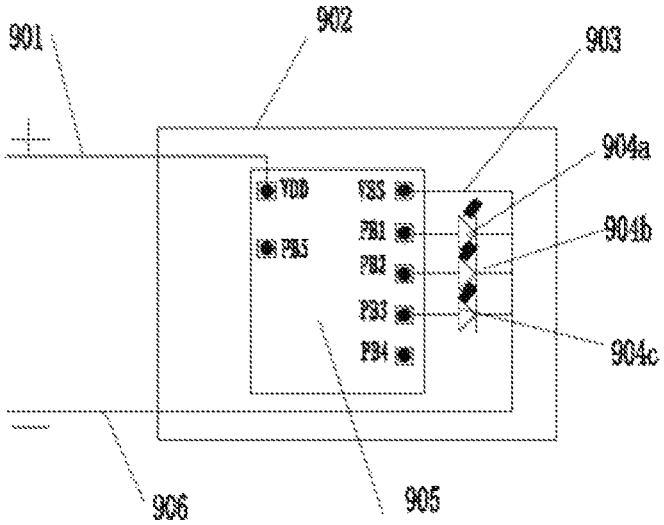
FIG. 9 is a structure diagram of a third light-emitting-selectable LED lamp bead of the present invention.

The light-emitting-selectable LED lamp bead 9 as shown in FIG. 9 has three LED light emitting chips in it, namely, LED light emitting chip A 904*a*, LED light emitting chip B 904*b* and LED light emitting chip C 904*c*, and the light-emitting-selectable LED lamp bead 9 may have a plurality of lighting modes, such as color change (single-color lighting according to a single-color light emitting chip of LED light emitting chip A 904*a* or LED light emitting chip B 904*b* or LED light emitting chip C 904*c*, or blending-color lighting according to the blending color formed by different proportions of the three light emitting chips), on and off, bright and dark, and a plurality of flickering ways with different illuminant colors; these lighting modes are preset in the control chip 905 according to the requirements of a customer; after set, the lighting modes are fixed and sequential; after the lamp string is electrified, the lamp lights up first according to a first mode; by operating the controller 3, the lamp lights up according to a plurality of set lighting modes in sequence repeatedly.

Figure 10:
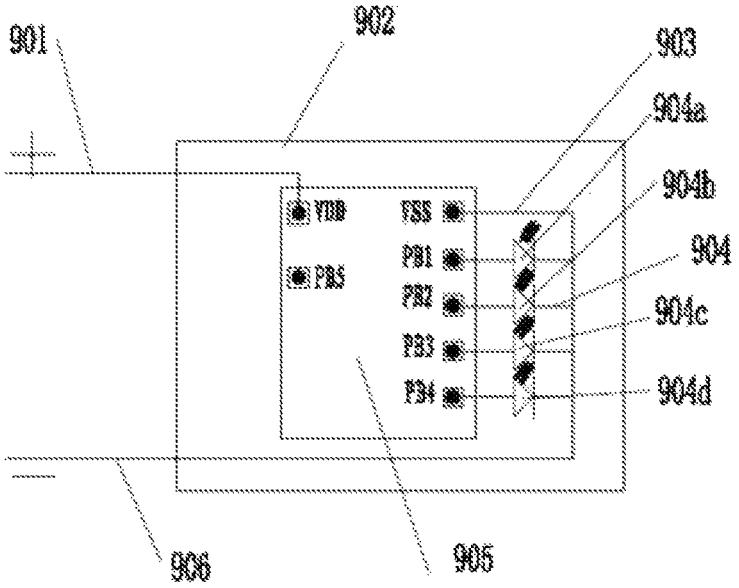
FIG. 10 is a structure diagram of a fourth light-emitting-selectable LED lamp bead of the present invention.

The light-emitting-selectable LED lamp bead 9 as shown in FIG. 10 has four LED light emitting chips in it, namely, LED light emitting chip A 904*a*, LED light emitting chip B 904*b*, LED light emitting chip C 904*c* and LED light emitting chip D 904*d*, and the light-emitting-selectable LED lamp bead 9 may have a plurality of lighting modes, such as color change (single-color lighting according to a single-color light emitting chip of LED light emitting chip A 904*a* or LED light emitting chip B 904*b* or LED light emitting chip C 904*c* or LED light emitting chip D 904*d*, or blending-color lighting according to the blending color formed by different proportions of the four light emitting chips), on and off, bright and dark, and a plurality of flickering ways with different illuminant colors; these lighting modes are preset in the control chip 905 according to the requirements of a customer; after set, the lighting modes are fixed and sequential; after the lamp string is electrified, the lamp lights up first according to a first mode; by operating the controller 3, the lamp lights up according to a plurality of set lighting modes in sequence repeatedly.

Figure 11:
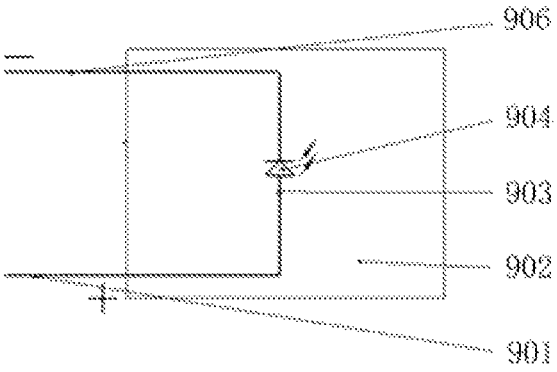
FIG. 11 is a structure diagram of a common LED lamp bead of the present invention.

FIG. 11 shows a structure diagram of a common LED lamp bead 8, the common LED lamp bead 8 comprises a lamp bead encapsulation body 902, and a lamp bead positive electrode pin 901, an encapsulation wire 903, a lamp bead negative electrode pin 906 and an LED light emitting chip 904 that are fixed on the lamp bead encapsulation body 902; the LED light emitting chip 904 is connected with the lamp bead positive electrode pin 901 and the lamp bead negative electrode pin 906 through the encapsulation wire 903; the common LED lamp beads 8, or the common LED lamp bead 8 and the light-emitting-selectable LED lamp bead are connected with each other in series or in parallel through the encapsulation wire 903.

The light-emitting-selectable LED lamp beads 9 used on one same lamp string of the present invention are of the same or different types; the control chip 905, the number and type of the LED light emitting chips and the corresponding connection modes arranged in one same type of light-emitting-selectable LED lamp beads 9 are the same, and the lighting mode of the same type of light-emitting-selectable LED lamp beads 9 is the same too; all light-emitting-selectable LED lamp beads 9 on the lamp string set have the same lighting mode switching way. During the production of the lamp string, one or more types of light-emitting-selectable LED lamp beads 9 may be mounted at a specified position according to the requirements of a customer; the connection way of the light-emitting-selectable LED lamp bead 9 and/or the common LED lamp bead 8 on each lamp substring of the lamp string set 6 may also be determined as needed; the connection way between each lamp substring is determined according to the connection way of the lamp bead and a required power supply.

The lamp string of the present invention may have a plurality of connection ways; the position on the lamp string for installing the light-emitting-selectable LED lamp bead 9 and the type of the light-emitting-selectable LED lamp bead 9 may have a myriad number of choices; the embodiment of the present invention just gives several examples, but this does not influence the protection scope of the present invention.

As shown in FIG. 1, two lamp substrings are installed with a respective light-emitting-selectable LED lamp bead 9 shown in FIG. 7, FIG. 8, FIG. 9 and FIG. 10 at different sequences of positions respectively; the light-emitting-selectable LED lamp beads 9 of this embodiment shown in FIG. 7, FIG. 8, FIG. 9 and FIG. 10 respectively are of the same type, and, by operating the controller, respective lighting modes are synchronously switched respectively. The common LED lamp bead 8 and the light-emitting-selectable LED lamp bead 9 on the lamp substring of this embodiment are connected with each other in series, and the lamp substrings are connected with each other in parallel. Each lamp substring of the present invention is connected with a resistor, which achieves the function of limiting current and adjusting voltage in the lamp string to prevent the overload of the lamp bead.

Figure 2:
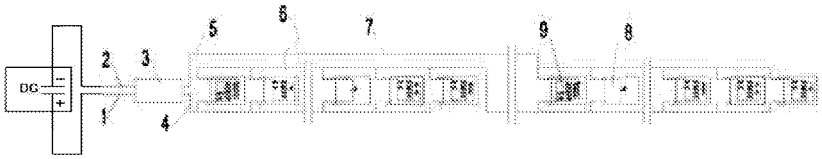
FIG. 2 is a structure diagram of a second embodiment of the present invention.

As shown in FIG. 2, two lamp substrings are installed with a respective light-emitting-selectable LED lamp bead 9 shown in FIG. 7, FIG. 8, FIG. 9 and FIG. 10 at different sequences of positions respectively; the light-emitting-selectable LED lamp beads 9 of this embodiment shown in FIG. 7, FIG. 8, FIG. 9 and FIG. 10 respectively are of the same type, and, by operating the controller, respective lighting modes are synchronously switched respectively. The common LED lamp bead 8 and the light-emitting-selectable LED lamp bead 9 on the lamp substring of this embodiment are connected with each other in parallel, and the lamp substrings are connected with each other in series.

Figure 3:
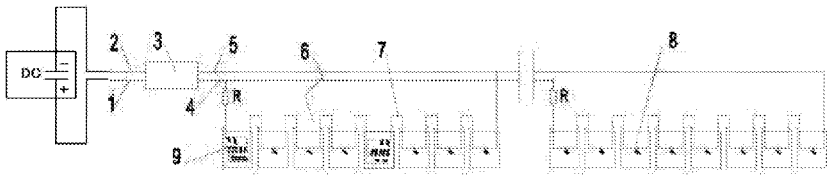
FIG. 3 is a structure diagram of a third embodiment of the present invention.

As shown in FIG. 3, the former lamp substring is installed with a respective light-emitting-selectable LED lamp bead 9 shown in FIG. 8 and FIG. 10 at different sequences of positions respectively, and the latter lamp substring is composed of the common LED lamp beads 8 only. By operating the controller, the two light-emitting-selectable LED lamp beads 9 respectively switch lighting according to respective inbuilt various set lighting modes. The common LED lamp bead 8 and the light-emitting-selectable LED lamp bead 9 on the lamp substring of this embodiment are connected with each other in series, and the lamp substrings are connected with each other in parallel. Each lamp substring of the present invention is connected with a resistor, which achieves the function of limiting current and adjusting voltage in the lamp string to prevent the overload of the lamp bead.

Figure 4:
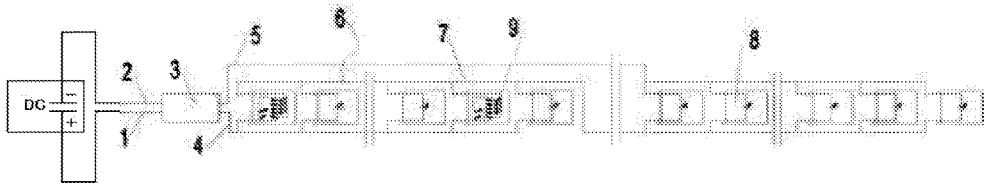
FIG. 4 is a structure diagram of a fourth embodiment of the present invention.

As shown in FIG. 4, the former lamp substring is installed with one same type of light-emitting-selectable LED lamp beads 9 shown in FIG. 10 at different sequences of positions respectively, and the latter lamp substring is composed of the common LED lamp beads 8 only. By operating the controller, the two light-emitting-selectable LED lamp beads 9 synchronously switch lighting according to various set lighting modes. The common LED lamp bead 8 and the light-emitting-selectable LED lamp bead 9 on the lamp substring of this embodiment are connected with each other in parallel, and the lamp substrings are connected with each other in series.

Figure 5:
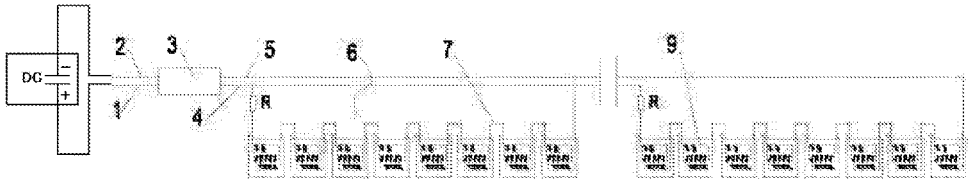
FIG. 5 is a structure diagram of a fifth embodiment of the present invention.

As shown in FIG. 5, two lamp substrings both are composed of one same type of light-emitting-selectable LED lamp beads 9 shown in FIG. 10 only; by operating the controller, all the lamp beads synchronously switch lighting according to various set lighting modes. The light-emitting-selectable LED lamp beads 9 on the lamp substring of this embodiment are connected with each other in series, and the lamp substrings are connected with each other in parallel. Each lamp substring of the present invention is connected with a resistor, which achieves the function of limiting current and adjusting voltage in the lamp string to prevent the overload of the lamp bead.

Figure 6:
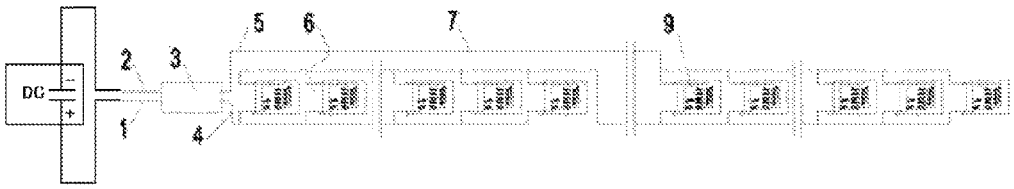
FIG. 6 is a structure diagram of a sixth embodiment of the present invention.

As shown in FIG. 6, two lamp substrings both are composed of one same type of light-emitting-selectable LED lamp beads 9 shown in FIG. 9 only; by operating the controller, all the lamp beads synchronously switch lighting according to various set lighting modes. The light-emitting-selectable LED lamp beads 9 on the lamp substring of this embodiment are connected with each other in parallel, and the lamp substrings are connected with each other in series.

Figure 12:
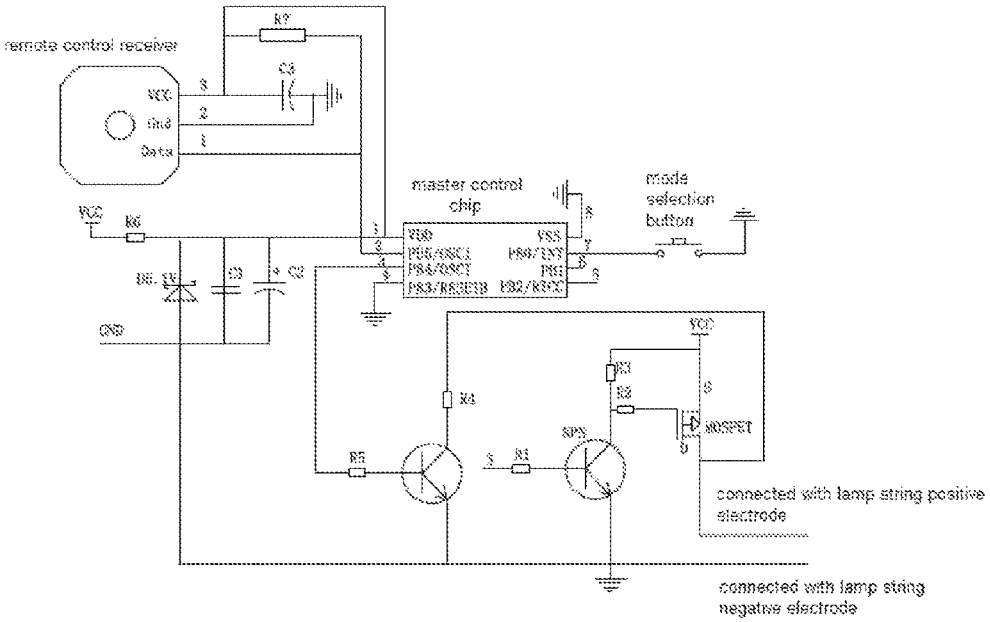
FIG. 12 is a schematic diagram of a controller of an LED lamp string having a selectable light emitting mode of the present invention.

As shown in FIG. 12, the controller 3 of the present invention has an internal control principle as follows: the controller 3 is inbuilt with a master control IC, the master control IC encapsulates a program matched with the lighting mode set inside the control chip 905; a circuit composed of R6, D5.1V, C1 and C2 provides a stable supply voltage for the master control chip; a remote control receiver, C3 and R7 form a remote controller signal receiving circuit, which is responsible for transmitting a signal sent by the remote controller to the master control IC through an input/output pin of the master control IC; R4, R5 and NPN1 triode form a feedback circuit, which feeds back a signal output from the MOSFET tube to the master control chip, ensuring that, once the "mode selection button" or remote controller is operated, regardless of the length of press time (that is, the length of time for touching the button contact), the master control chip considers that a trigger signal is received, so that the reliability of mode switch is improved. After the master control chip receives a trigger signal, the master control chip operates through the internal program, then, Pin No. 5 outputs a trigger signal, a switch circuit composed of R1, R2, R3, NPN2 triode and MOSFET tube switches off the power supply of the lamp string for one time, such that the control chips inside all light-emitting-selectable LED lamp beads 9 on the lamp string uniformly receive a trigger signal, thereby enabling the light-emitting-selectable LED lamp beads 9 on the lamp string to uniformly switch lighting for one time according to internal different preset lighting modes, in this way, each time one trigger is added, the light-emitting-selectable LED lamp beads 9 are uniformly switched to a next preset lighting mode; when switched to the last lighting mode, if a new trigger is added, the light-emitting-selectable LED lamp beads 9 will be automatically restored to the preset first lighting mode. When the lamp string of the present invention is powered on, all light-emitting-selectable LED lamp beads on the lamp string light up according to the first lighting mode of respective inbuilt lighting modes; a plurality of lighting modes are built in the control chip of the light-emitting-selectable LED lamp bead and the sequence of each mode is preset; each time a trigger is added, the lighting mode is gradually changed according to the determined sequence, such cycle is repeated.

According to the present invention, since all light emitting parts only have two encapsulation pins, which are utilized to serve as both power pin and signal pin ingeniously, the lamp string is very simple in structure and very low in manufacturing cost and is beneficial for mass production; the light-emitting-selectable LED lamp beads are used, such that the lighting modes of all light-emitting-selectable LED lamp beads of the same type on the lamp string are synchronously controllable; the lamp string has simple structure and diverse lighting effects, meets the personalized lighting requirements of people, and has novelty and usage convenience.

What is claimed is:

1. An LED lamp string having a selectable light emitting mode, comprising a power line positive electrode, a power line negative electrode, a controller, a lamp string input positive electrode, a lamp string input negative electrode, a lamp string set and a connecting wire, wherein one end of the power line positive electrode and one end of the power line negative electrode are connected with a positive electrode and a negative electrode of a direct-current power respectively; the other end of the power line positive electrode and the other end of the power line negative electrode are respectively connected with the input end of the controller; the output end of the controller is connected with the lamp string input positive electrode and the lamp string input negative electrode respectively; the lamp string set comprises at least one lamp substring and at least one light-emitting-selectable LED lamp bead; the light-emitting-selectable LED lamp bead used on the lamp string set is of the same or different types; after the LED lamp string is electrified, by operating the controller, each light-emitting-selectable LED lamp bead on the lamp string lights up according to a plurality of set lighting modes, and various lighting modes of one same type of light-emitting-selectable LED lamp beads are synchronously controllable; and all light-emitting-selectable LED lamp beads used on the LED lamp string set have the same lighting mode switching way;

wherein the light-emitting-selectable LED lamp bead comprises a lamp bead encapsulation body, and a lamp bead positive electrode pin, an encapsulation wire, a control chip, a lamp bead negative electrode pin and an LED light emitting chip that are fixed on the lamp bead encapsulation body, wherein the power positive electrode of the control chip is connected with the lamp bead positive electrode pin through the encapsulation wire, the power negative electrode of the control chip is connected with the lamp bead negative electrode pin through the encapsulation wire, one electrode of the LED light emitting chip is connected with the output end of the control chip through the encapsulation wire, the other electrode of the LED light emitting chip is connected with the lamp bead negative electrode pin through the encapsulation wire or conductive glue, the lamp bead encapsulation body is used to fix and protect the lamp bead positive electrode pin, the control chip, the encapsulation wire, the LED light emitting chip and the lamp bead negative electrode pin and to achieve the function of lamp bead shaping.

2. The LED lamp string having a selectable light emitting mode according to claim 1, wherein on the lamp string set a plurality of lamp substring sets are connected with each other in parallel or in series through the connecting wire.

3. The LED lamp string having a selectable light emitting mode according to claim 1, wherein on the lamp substring, a common LED bead and the light-emitting-selectable LED lamp bead, the light-emitting-selectable LED lamp bead and the light-emitting-selectable LED lamp bead are connected with each other in parallel or in series through the connecting wire.

4. The LED lamp string having a selectable light emitting mode according to claim 1, wherein the LED light emitting chip comprises at least one of an LED light emitting chip A, and/or an LED light emitting chip B, and/or an LED light emitting chip C, and/or an LED light emitting chip D, wherein one electrode of the LED light emitting chip A, one electrode of the LED light emitting chip B, one electrode of the LED light emitting chip C and one electrode of the LED light emitting chip D are connected with the output ends PB1, PB2, PB3 and PB4 of the control chip respectively through the encapsulation wire, and the other electrode of the LED light emitting chip A, the other electrode of the LED light emitting chip B, the other electrode of the LED light emitting chip C and the other electrode of the LED light emitting chip D are connected with the lamp bead negative electrode pin through the encapsulation wire or conductive glue.

5. The LED lamp string having a selectable light emitting mode according to claim 1, wherein a plurality of lighting modes are set inside the control chip according to the configuration of the LED light emitting chip and the requirements of a user.

6. The LED lamp string having a selectable light emitting mode according to claim 1, wherein the LED lamp string further comprises a remote controller, which is connected with the controller through a radio signal.

7. The LED lamp string having a selectable light emitting mode according to claim 1, wherein the control chip, the number and type of the LED light emitting chips and the corresponding connection modes arranged in one same type of light-emitting-selectable LED lamp beads are the same.

8. The LED lamp string having a selectable light emitting mode according to claim 2, wherein the light-emitting-selectable LED lamp bead comprises a lamp bead encapsulation body, and a lamp bead positive electrode pin, an encapsulation wire, a control chip, a lamp bead negative electrode pin and an LED light emitting chip that are fixed on the lamp bead encapsulation body, wherein the power positive electrode of the control chip is connected with the lamp bead positive electrode pin through the encapsulation wire, the power negative electrode of the control chip is connected with the lamp bead negative electrode pin through the encapsulation wire, one electrode of the LED light emitting chip is connected with the output end of the control chip through the encapsulation wire, the other electrode of the LED light emitting chip is connected with the lamp bead negative electrode pin through the encapsulation wire or conductive glue, the lamp bead encapsulation body is used to fix and protect the lamp bead positive electrode pin, the control chip, the encapsulation wire, the LED light emitting chip and the lamp bead negative electrode pin and to achieve the function of lamp bead shaping.

9. The LED lamp string having a selectable light emitting mode according to claim 8, wherein the LED light emitting chip comprises at least one of an LED light emitting chip A, and/or an LED light emitting chip B, and/or an LED light emitting chip C, and/or an LED light emitting chip D, wherein one electrode of the LED light emitting chip A, one electrode of the LED light emitting chip B, one electrode of the LED light emitting chip C and one electrode of the LED light emitting chip D are connected with the output ends PB1, PB2, PB3 and PB4 of the control chip respectively through the encapsulation wire, and the other electrode of the LED light emitting chip A, the other electrode of the LED light emitting chip B, the other electrode of the LED light emitting chip C and the other electrode of the LED light emitting chip D are connected with the lamp bead negative electrode pin through the encapsulation wire or conductive glue.

10. The LED lamp string having a selectable light emitting mode according to claim 8, wherein a plurality of lighting modes are set inside the control chip according to the configuration of the LED light emitting chip and the requirements of a user.

11. The LED lamp string having a selectable light emitting mode according to claim 8, wherein the control chip, the number and type of the LED light emitting chips and the corresponding connection modes arranged in one same type of light-emitting-selectable LED lamp beads are the same.

12. The LED lamp string having a selectable light emitting mode according to claim 3, wherein the light-emitting-selectable LED lamp bead comprises a lamp bead encapsulation body, and a lamp bead positive electrode pin, an encapsulation wire, a control chip, a lamp bead negative electrode pin and an LED light emitting chip that are fixed on the lamp bead encapsulation body, wherein the power positive electrode of the control chip is connected with the lamp bead positive electrode pin through the encapsulation wire, the power negative electrode of the control chip is connected with the lamp bead negative electrode pin through the encapsulation wire, one electrode of the LED light emitting chip is connected with the output end of the control chip through the encapsulation wire, the other electrode of the LED light emitting chip is connected with the lamp bead negative electrode pin through the encapsulation wire or conductive glue, the lamp bead encapsulation body is used to fix and protect the lamp bead positive electrode pin, the control chip, the encapsulation wire, the LED light emitting chip and the lamp bead negative electrode pin and to achieve the function of lamp bead shaping.

13. The LED lamp string having a selectable light emitting mode according to claim 12, wherein the LED light emitting chip comprises at least one of an LED light emitting chip A, and/or an LED light emitting chip B, and/or an LED light emitting chip C, and/or an LED light emitting chip D, wherein one electrode of the LED light emitting chip A, one electrode of the LED light emitting chip B, one electrode of the LED light emitting chip C and one electrode of the LED light emitting chip D are connected with the output ends PB1, PB2, PB3 and PB4 of the control chip respectively through the encapsulation wire, and the other electrode of the LED light emitting chip A, the other electrode of the LED light emitting chip B, the other electrode of the LED light emitting chip C and the other electrode of the LED light emitting chip D are connected with the lamp bead negative electrode pin through the encapsulation wire or conductive glue.

14. The LED lamp string having a selectable light emitting mode according to claim 12, wherein a plurality of lighting modes are set inside the control chip according to the configuration of the LED light emitting chip and the requirements of a user.

15. The LED lamp string having a selectable light emitting mode according to claim 12, wherein the control chip, the number and type of the LED light emitting chips and the corresponding connection modes arranged in one same type of light-emitting-selectable LED lamp beads are the same.

16. The LED lamp string having a selectable light emitting mode according to claim 2, wherein the LED lamp string further comprises a remote controller, which is connected with the controller through a radio signal.

17. The LED lamp string having a selectable light emitting mode according to claim 3, wherein the LED lamp string further comprises a remote controller, which is connected with the controller through a radio signal.

* * * * *